US006402072B1

(12) United States Patent
Lehtonen et al.

(10) Patent No.: US 6,402,072 B1
(45) Date of Patent: Jun. 11, 2002

(54) METHOD FOR SECURING A DIE PLATE OF A JAW CRUSHER, AND A JAW CRUSHER

(75) Inventors: Harri Lehtonen; Janne Keskinen, both of Tampere (FI)

(73) Assignee: Metso Minerals (Tampere) Oy, Tampere (FI)

( * ) Notice: Subject to any disclaimer, the term of this patent is extended or adjusted under 35 U.S.C. 154(b) by 0 days.

(21) Appl. No.: 09/581,680

(22) PCT Filed: Dec. 21, 1998

(86) PCT No.: PCT/FI98/01006

§ 371 (c)(1),
(2), (4) Date: Sep. 19, 2000

(87) PCT Pub. No.: WO99/32227

PCT Pub. Date: Jul. 1, 1999

(30) Foreign Application Priority Data

Dec. 22, 1997 (FI) ..... 974592

(51) Int. Cl.[7] ..... B02C 1/02
(52) U.S. Cl. ..... 241/264; 29/525.02
(58) Field of Search ..... 241/264–269, 241/291, 300, 294, 295, 293; 29/525.02

(56) References Cited

U.S. PATENT DOCUMENTS 2,258,075 A * 10/1941 Symons
3,984,058 A 10/1976 Archer et al.
4,039,151 A * 8/1977 Coxhill et al.
6,155,507 A * 12/2000 Ostergaard ..... 241/264

FOREIGN PATENT DOCUMENTS

| | | |
|---|---|---|
| AT | 327 655 | 2/1976 |
| DE | 41 08 517 | 9/1991 |

* cited by examiner

*Primary Examiner*—Mark Rosenbaum
(74) *Attorney, Agent, or Firm*—Burns, Doane, Swecker & Mathis, L.L.P.

(57) ABSTRACT

A method for mounting a jaw die plate (9) of a jaw crusher detachably against a front end wall (10) of the crusher by means of a fastening device (18) operated from outside a side wall (7) of the crusher. The die plate (9) is secured in its place by means of friction between the fastening device (18) and a counter surface (22) of the front end wall (10) and friction between the fastening device (18) and a counter surface (23) of the die plate. The fastening device of the jaw crusher includes a wedge piece (18) having a first pressing surface to be fitted against the counter surface (23) of the die plate (9) secured against the front end (10) of the crusher, and, in addition to that, a second pressing surface to be fitted against the counter surface (22) of the front end wall. The wedge piece (18) is movable towards both counter surfaces (23, 22) and away from the same by means of the tightening means (19, 24, 20).

20 Claims, 3 Drawing Sheets

METHOD FOR SECURING A DIE PLATE OF A JAW CRUSHER, AND A JAW CRUSHER

TECHNICAL FIELD OF THE INVENTION

The present invention concerns a method for securing a jaw die plate of a jaw crusher detachably against the front end wall of a jaw crusher. The invention also concerns a jaw crusher.

BACKGROUND ART

The stationary jaw die plate or plates of a jaw crusher are conventionally secured to the front end wall or front frame of the crusher, by fastening them by bolting through said end wall. The jaw die plate is pressed against the front end wall by means of a wedge, a recess made to an aperture of said wedge receiving the head of the fastening bolt. Usually, so called hammer-type bolts are used as fastening bolts. The jaw die plate can be divided vertically into two or more separate wearing parts.

For mounting a stationary jaw die plate to the crusher, there must be space provided in front of the front end wall of the crusher. Often the problem is that the required space is not available, but immediately in front of the crusher there are e.g. supporting structures of the feeding device feeding the crusher, or, provided under the feeding device there is a by-pass chute for the fines, meant for removing the fines from the feed material. These structures must be removed in order to install the jaw die plate, which is time consuming and causes costs and production losses.

Generally, the securing wedges of the jaw die plates are located as extensions to the upper and lower parts of the jaw die plate, so that also the front end wall of the crusher must extend behind the securing wedges. This means that the front end wall of the crusher must be considerably higher than the jaw die plate. The material to be crushed is fed into the opening of the crusher over the front end wall of the crusher, so that in a traditional solution, the feeding device must be unnecessarily high with respect to the jaw die plate which performs the crushing work itself.

Known in the art there are also such securing methods of the jaw die plate, in which the jaw die plate is wedged against the front end wall by means of a side wedge or cheek plate provided respectively on both sides of the jaw. The cheek plate also acts as a protection for the side plate of the crusher. The wearing of the cheek plates, however, is minor compared to the wearing of the crushing jaw die plates, so that the detaching of the cheek plates when changing the jaw die plates is unnecessary work.

Patent publication U.S. Pat. No. 3,984,058 discloses a jaw crusher, in which the jaw die plate is secured by its sides to the side plates of the crusher by means of angle pieces. One end of an angle piece is bolted to the side plate. The surface of the angle piece to be fitted against the side plate is tapered, so that when the bolt is tightened, the angle piece pivots about its vertical corner edge. The end of the angle piece facing towards the side plate is beveled, and when the angle piece turns, it is forced against the bevelled counter surface of the internal cheek plate of the side plate. The other, blunt end of the angle piece is forced against a diagonal counter surface in the recess of the jaw die plate. One component of the securing force arising in this way forces the jaw die plate against the front end wall, and the second component prohibits the lateral movement of the die plate. In this prior art solution, again, the side plate cannot be detached without removing the jaw die plate. This construction requires dimensional accuracy from the joint surfaces as well of the cheek plate as of the jaw die plate. Because these both pieces are made of a very hard material, they are difficult to be machined. That increases the production costs of the components.

DISCLOSURE OF THE INVENTION

In the solution of the present invention, no mounting space is required in front of the front end wall of the crusher. This means that the changing of the jaw die plates is easier. It is not necessary to dismount the feed arrangements or fines removal systems for changing the jaw die plate, so that costs are reduced and production breaks shortened. The front end wall of the crusher can be constructed as low as the stationary jaw die plate and so the feeding level of the material can be lowered. This means a lower, lighter and less expensive crusher unit, as a whole. This is significant especially with mobile and self-propelled crusher units.

Further, the solution in accordance with the invention does not require complicated machining of the jaw die plate, which would be a very expensive operation, as the die plate is manufactured of hard and high-tensile alloy steel.

In the solution of the invention, the jaw die plate is secured to the front end wall of the crusher by means of a mechanism which in the direction of the normal of the surface of the front end wall and the rear surface of the stationary jaw die plate of the crusher, is mainly friction restrained. In other words, the jaw die plate is prevented from loosening from the front end wall by means of a friction force which is parallel to the normal of the surface of the front end wall of the crusher, said friction force being generated between two or a plurality of pressing surfaces by applying thereto a force parallel to the plane of the front end wall of the crusher. Additional security can be provided by using different profiled restraint solutions, the main part of the restraint action, however, being generated by the friction force.

BRIEF DESCRIPTION OF THE DRAWINGS

The invention and its details will now be described in detail in the following, with reference to the enclosed drawings, wherein.

MODES FOR CARRYING OUT THE INVENTION

Figure 1:
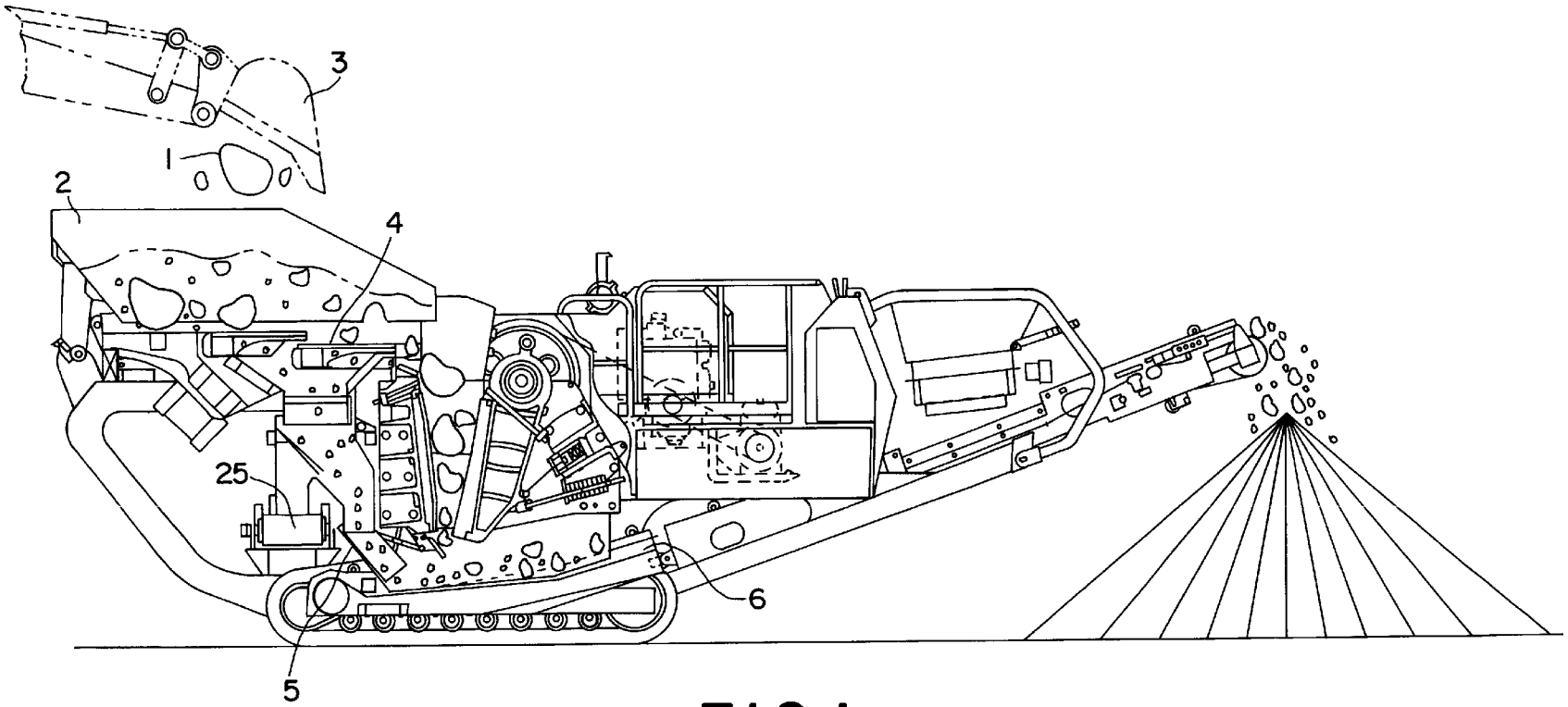
FIG. 1 is a vertical section of a crawler-mounted crusher unit.

FIG. 1 describes a crawler-mounted crusher unit independently movable on the site, known in the art. Material 1 to be crushed can be fed to the feed hopper 2 of the unit e.g. by means of a digger 3. From the feed hopper, the material is transferred by a vibrating feeder 4 to the opening of the crusher, fines being simultaneously separated and led through a by-pass chute 5 to a discharging conveyor 25 or a main conveyor 6, where it is combined with the breaker product coming from the crusher. In the crusher, the rock material is crushed into the final product, the particle size depending on the setting of the crusher.

Figure 2:
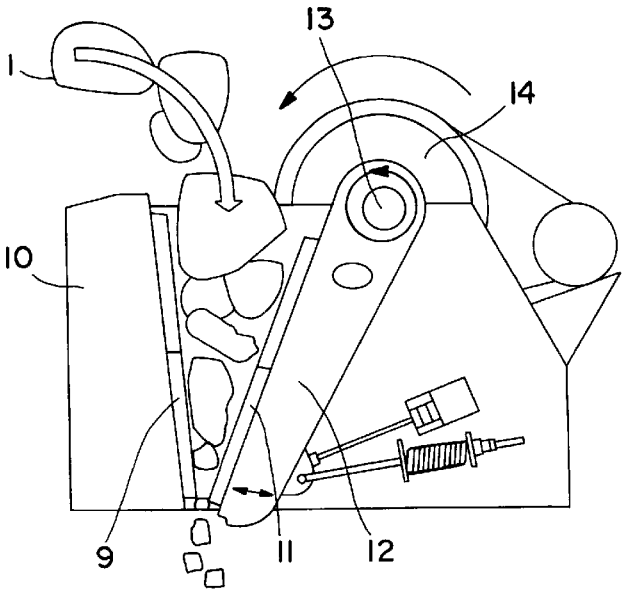
FIG. 2 PRIOR ART
FIG. 2 shows the functional principle of a crusher as a schematic drawing.
Figure 3:
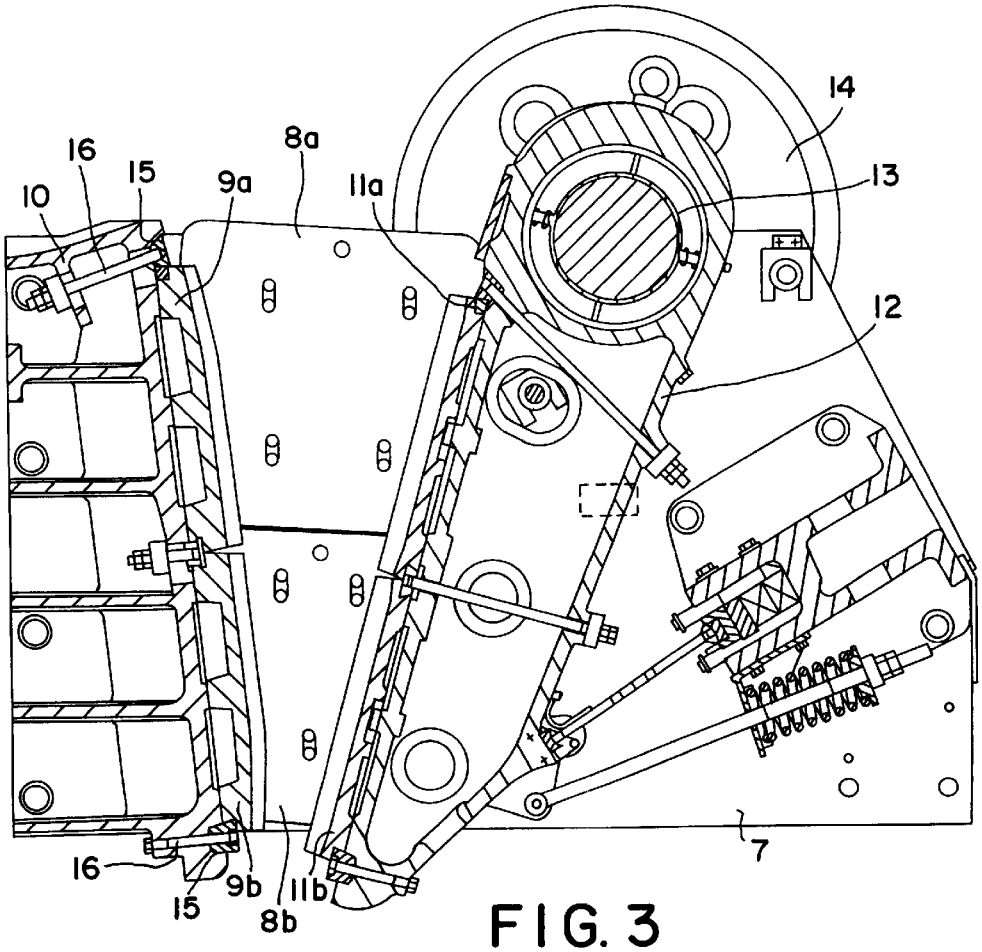
FIG. 3 PRIOR ART
FIG. 3 is a vertical section of a jaw crusher of prior art.

FIGS. 2 and 3 show the main components of a jaw crusher known in the art The crusher comprises side plates 7 on its both sides, side wedges or cheek plates 8*a*–8*b* being mounted on their inner surface, respectively. A stationary crushing jaw 9 is attached to a front end wall 10 or front frame. A moving crushing jaw 11 is mounted to a pitman 12. The jaw die plates 9 and 11 can be made of one or two pieces 9*a*–9*b*, 11*a*–11*b*, thereby comprising an upper jaw and a lower jaw. The jaw die plates can be divided even into a plurality of pieces. The pitman 12 is mounted at its upper end by an eccentric shaft 13 passing through the hole of the pitman and mounted with bearings in the hole of the pitman and to the side plates of the crusher. The pivoting movement of the pitman is accomplished by rotating this eccentric shaft in the hole of the pitman by means of a fly wheel 14. The surfaces of the jaw die plates can be corrugated in different manners.

Material can be fed into the crusher e.g. as shown in FIG. 1, by means of a vibrating feeder 4. The fly wheel 14, and simultaneously the eccentric shaft 13, are driven by a motor. Caused by the eccentric motion of the eccentric shaft, the pitman 12 of the crusher and the is jaw die plate 11 mounted thereto, move back and forth, towards the stationary jaw die plate 9 and away therefrom, so that the rock is crushed between the jaws.

When the stationary jaw die plate 9 is worn out, it must be changed. In a solution of FIG. 3, known in the art, the jaw die plate is secured by means of wedges 15 and bolts 16 to be tightened through the front end wall 10. The wedges and the bolts force the die plate against the front end wall at the upper and lower portions of the front end wall and the die plate. In a die plate made of two pieces there are wedges and bolts also in the joint of the die plate. For changing the die plate, the components in front of the front end wall must be dismounted, that is, in the embodiment of FIG. 1, the supporting structures of the vibrating feeder 4 and the by-pass chute 5.

Figure 4:
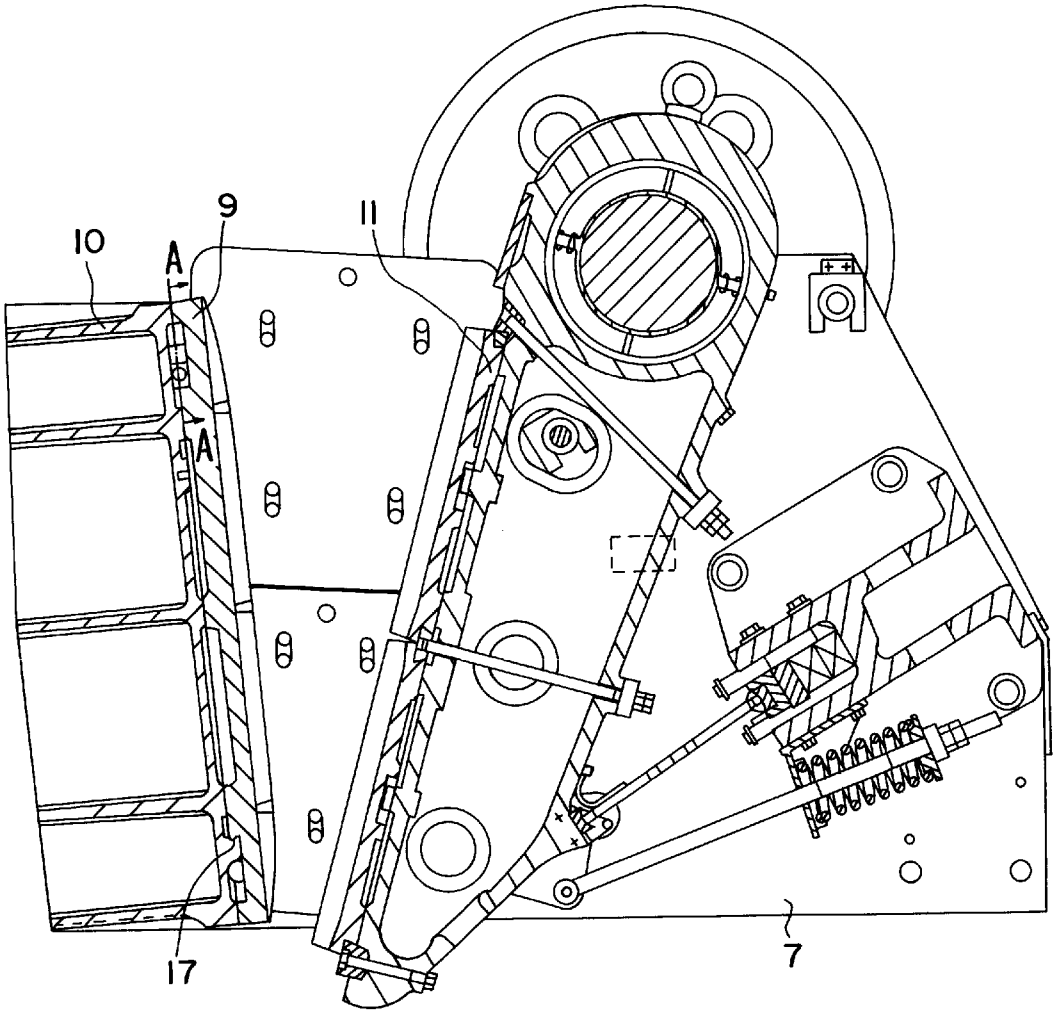
FIG. 4 is a vertical section of a jaw crusher in accordance with the present invention.
Figure 5:
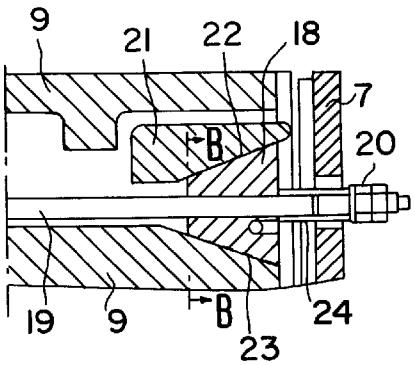
FIG. 5 is an enlarged section A—A of FIG. 4.

A jaw crusher of the present invention is shown in FIGS. 4 and 5. In the lower part of the front end wall 10 there is a longitudinal ridge or projection 17 with a beveled upper surface. The jaw die plate 9 has a corresponding beveled counter surface resting against the projection. The upper surface of the projection, against which the counter surface of the die plate is supported, forms with the inner surface of the front end wall an angle opening upwards, said angle being smaller than 90°. The projection extends preferably over the whole width of the front end wall, or over the main part of the width. The jaw die plate is placed leaning against the front end wall 10, so that it rests on the projection 17 of the front end wall.

Attachment of the stationary jaw die plate 9 at its upper part is shown in FIG. 5. The die plate is secured at the sides of the front end wall 10, through both side plates 7 of the crusher. The die plate is secured by means of a wedge 18 and a rod 19 passing through the wedge and a nut 20 at the end of the rod. The front end wall 10 is provided with a projection 21, projecting outwards from the plane of the front end wall, into a recess of the die plate. The projection 21 has a counter surface 22, against which one wedge surface of the wedge 18 sets. The other wedge surface of the wedge 18 sets against a counter surface 23 of the die plate 9. Both ends of the rod 19 are threaded and provided with a nut 20. Between the nut 20 and the wedge 18 there is a pipe 24.

The wedge 18 is forced between the die plate 9 and the projection 21 of the front end wall by means of the pipe, by turning the nut on the rod. The counter surfaces 23 and 22 of the die plate and the front end wall are pressed against the wedge surface of the wedge and are thus secured to the wedge by means of friction. Due to this, the die plate and the front end wall are kept together. A corresponding wedge 18 and a projection 21, as well as a counter surface 23 of the die plate, are provided also on the other side of the front end wall, and the rod 19 extends through the whole crusher.

In order to facilitate the detaching of the wedge 18, the size of the wedge angle of the wedge 18 must be determined so that the wedge is not self-locking. The self-locking limit angle depends on the friction coefficient between the surfaces. In practice the self-locking limit angle with clean steel surfaces is about 16 . . . 18°.

Figure 6:
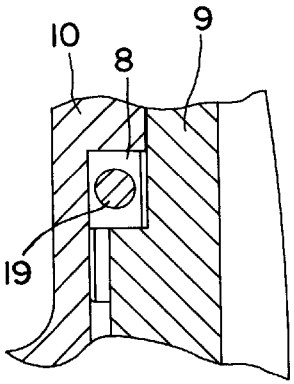
FIG. 6 is section B—B of FIG. 5.

It is preferable that the wedge 18 and the counter surfaces 22, 23 are shaped so that the planes of the extensions of the pressing surfaces do not intersect on a line totally parallel to the normal of the joint surface of the front end wall and the die plate, but they form, as shown in FIG. 6, an angle of e.g. about 5°, whereby the attachment of the die plate is not totally friction restraint. This has the advantage that when the securing means 19, 24, 20 slightly loosens, e.g. due to an inefficient re-tightening, the die plate still stays in place. This is to avoid damages caused by the eventual loosening of the die plate.

A jaw die plate made of two pieces can be secured in a corresponding way. Then, the front end plate is provided with a projection for the lower side of as well the upper as the lower die plate. Correspondingly, the securing by means of wedges to the side plates is provided at the sides of the upper portion of as well the upper as the lower die plate. Respectively, the invention is also applicable to jaw die plates made of several parts.

As described above, it is obvious that with a crusher in accordance with the present invention, when changing the jaw die plate, the detaching and attaching of the jaw die plate can be accomplished by handling securing means readily accessible from outside the side plate. It is not necessary to dismount any components in front of the front end wall.

The present invention is not restricted to the above described embodiment only, but it can vary in different ways within the scope of the claims. The frame of the crusher can also be made of one casting, so that both ends of the crusher and both side plates form a single cast.

What is claimed is:

1. A method for securing a jaw die plate of a jaw crusher detachably against a front end wall of the crusher comprising positioning the jaw die plate adjacent the front end wall and between side walls of a frame of the jaw crusher without opening the frame; and operating a fastening means from outside the side walls of the crusher to provide a force for holding the jaw die plate against the front end wall, the force including a force parallel to the front end wall.

2. A jaw crusher, comprising:

a frame of the jaw crusher including two opposing side walls and a front end wall;

a first jaw die plate and an opposing second jaw die plate, the first jaw die plate being movable back and forth relative to the second jaw die plate, the second jaw die plate being disposed between the side walls;

the second jaw die plate being detachably secured against the front end wall; and fastening equipment including at least one wedge piece having a first pressing surface arranged to fit against a first counter surface of the second jaw die plate and a second pressing surface arranged to fit against a second counter surface of the front end wall; and tightening means extending through at least one of the side walls and adapted to move the wedge piece relative to the first and second counter surfaces to detachably secure the second jaw die plate to the front end wall, wherein the second jaw die plate is adapted to be installed and removed relative to the frame without opening the frame.

3. A jaw crusher in accordance with claim 2, wherein the wedge piece is movable parallel to a longitudinal axis of a guide member of the tightening means.

4. A jaw crusher in accordance with claim 2, wherein the tightening means comprises a nut turnable along a threaded rod.

5. A jaw crusher, comprising:

side walls;

a first jaw die plate and an opposing second jaw die plate, the first jaw die plate being movable back and forth relative to the second jaw die plate, the second jaw die plate being disposed between the side walls;

a front end wall of the crusher against which the second jaw die plate is detachably secured; and fastening equipment including at least one wedge piece having a first pressing surface arranged to fit against a first counter surface of the second jaw die plate and a second pressing surface arranged to fit against a second counter surface of the front end wall and tightening means extending through at least one of the side walls and adapted to move the wedge piece relative to the first and second counter surfaces to detachably secure the second jaw die plate to the front end wall, wherein the second counter surface is part of a projection projecting from a plane of the front end wall towards the jaw die plate.

6. A jaw crusher in accordance with claim 5, wherein the first and the second pressing surfaces and the first and second counter surfaces are arranged so that planes of extensions of the first and second counter surfaces intersect each other along a line that intersects a plane of the front end wall, and at least part of the tightening means is between the first and second counter surfaces.

7. A jaw crusher in accordance with claim 6, wherein the wedge piece is movable parallel to a longitudinal axis of a guide member of the tightening means.

8. A jaw crusher in accordance with claim 6, wherein the planes of the extensions of the first and second counter surfaces intersect along a line which is perpendicular to the plane of the front end wall.

9. A jaw crusher in accordance with claim 8, wherein the wedge piece is movable parallel to a longitudinal axis of a guide member of the tightening means.

10. A jaw crusher in accordance with claim 5, wherein the wedge piece is movable parallel to a longitudinal axis of a guide member of the tightening means.

11. A jaw crusher in accordance with claim 5, wherein a lower part of the front end wall is provided with a ridge, an upper surface thereof being beveled so that it forms an angle opening upward with a plane of the front end wall that is smaller than 90°, and wherein a lower edge of the second jaw die plate is supported against the ridge.

12. A jaw crusher in accordance with claim 5, wherein the tightening means comprises a nut turnable along a threaded rod.

13. A jaw crusher, comprising:

side walls;

a first jaw die plate and an opposing second jaw die plate, the first jaw die plate being movable back and forth relative to the second jaw die plate, the second jaw die plate being disposed between the side walls;

a front end wall of the crusher against which the second jaw die plate is detachably secured; and fastening equipment including at least one wedge piece having a first pressing surface arranged to fit against a first counter surface of the second jaw die plate and a second pressing surface arranged to fit against a second counter surface of the front end wall and tightening means extending through at least one of the side walls and adapted to move the wedge piece relative to the first and second counter surfaces to detachably secure the second jaw die plate to the front end wall, wherein the first and the second pressing surfaces and the first and second counter surfaces are arranged so that planes of extensions of the first and second counter surfaces intersect each other along a line that intersects a plane of the front end wall, and at least part of the tightening means is between the first and second counter surfaces.

14. A jaw crusher in accordance with claim 13, wherein the planes of the extensions of the first and second counter surfaces intersect along a line which is perpendicular to the plane of the front end wall.

15. A jaw crusher in accordance with claim 14, wherein the wedge piece is movable parallel to a longitudinal axis of a guide member of the tightening means.

16. A jaw crusher in accordance with claim 14, wherein a lower part of the front end wall is provided with a ridge, an upper surface thereof being beveled so that it forms an angle opening upward with a plane of the front end wall that is smaller than 90°, and wherein a lower edge of the second jaw die plate is supported against the ridge.

17. A jaw crusher in accordance with claim 13, wherein the wedge piece is movable parallel to a longitudinal axis of a guide member of the tightening means.

18. A jaw crusher in accordance with claim 13, wherein a lower part of the front end wall is provided with a ridge, an upper surface thereof being beveled so that it forms an angle opening upward with a plane of the front end wall that is smaller than 90°, and wherein a lower edge of the second jaw die plate is supported against the ridge.

19. A jaw crusher in accordance with claim 13, wherein the tightening means comprises a nut turnable along a threaded rod.

20. A jaw crusher, comprising:

side walls;

a first jaw die plate and an opposing second jaw die plate, the first jaw die plate being movable back and forth relative to the second jaw die plate, the second jaw die plate being disposed between the side walls;

a front end wall of the crusher against which the second jaw die plate is detachably secured; and fastening equipment including at least one wedge piece having a first pressing surface arranged to fit against a first counter surface of the second jaw die plate and a second pressing surface arranged to fit against a second counter surface of the front end wall and tightening means extending through at least one of the side walls and adapted to move the wedge piece relative to the first and second counter surfaces to detachably secure the second jaw die plate to the front end wall, wherein a lower part of the front end wall is provided with a ridge, an upper surface thereof being beveled so that it forms an angle opening upward with a plane of the front end wall that is smaller than 90°, and wherein a lower edge of the second jaw die plate is supported against the ridge.

* * * * *